US006951520B2

(12) United States Patent
Ohama et al.

(10) Patent No.: US 6,951,520 B2
(45) Date of Patent: Oct. 4, 2005

(54) GOLF BALL

(75) Inventors: Keiji Ohama, Kobe (JP); Takahiro Sajima, Kobe (JP); Seiichiro Endo, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 129 days.

(21) Appl. No.: 10/700,663

(22) Filed: Nov. 5, 2003

(65) Prior Publication Data

US 2004/0102259 A1 May 27, 2004

(30) Foreign Application Priority Data

Nov. 25, 2002 (JP) ..... 2002-340486

(51) Int. Cl.[7] ..... A63B 37/14
(52) U.S. Cl. ..... 473/383
(58) Field of Search ..... 473/378–384

(56) References Cited

U.S. PATENT DOCUMENTS 6,616,548 B2 * 9/2003 Kato et al. ..... 473/371
2002/0065150 A1 5/2002 Kato et al.

* cited by examiner

*Primary Examiner*—Raeann Gorden
(74) *Attorney, Agent, or Firm*—Birch, Stewart, Kolasch & Birch, LLP

(57) ABSTRACT

Golf ball 1 has a core 2 and a cover 3. The core 2 is composed of a center 4 and a mid layer 5. Numerous dimples 6 are formed on the surface of the cover 3. Base polymer of the cover 3 includes a mixture of an ionomer resin and a thermoplastic elastomer as a principal component. Shore D hardness of this cover 3 is 55 or greater and 70 or less. A proportion of number of dimples 6 having the tilt angle α of from the position, which is 20% downward from the dimple edge in an in-depth direction, down to the position, which is 50% downward from the dimple edge, of 65° or greater and 85° or less occupied in total number of dimples is equal to or greater than 20%.

17 Claims, 4 Drawing Sheets

GOLF BALL

BACKGROUND OF THE INVENTION

1. Field of the Invention

The present invention relates to golf balls. More particularly, the present invention relates to golf balls having a core and a cover, with dimples being formed on the cover.

2. Description of the Related Art

Although golf balls having a balata cover prevailed previously, golf balls having a cover composed of a synthetic resin were thereafter developed, which have prevailed at present. Typical synthetic resins are ionomer resins. A variety of grade of ionomer resins have been used for golf balls. An ionomer resin has higher hardness in comparison with balata, and is excellent in a resilience performance. On the other hand, hard feel at impact is experienced according to this golf ball. Hard feel at impact has been avoided by senior golf players, in particular. When a synthetic resin having low hardness (typically, a thermoplastic elastomer) is used, feel at impact of the golf ball is improved. However, a synthetic resin having low hardness results in insufficient resilience performance.

JP-A-113129/2002 discloses a golf ball having a cover composed of a mixture of an ionomer resin and a thermoplastic styrene elastomer. In accordance with this golf ball, both of the resilience performance and the feel at impact are achieved concurrently by using an ionomer resin and a thermoplastic styrene elastomer in combination.

Golf balls having a cover composed of a mixture of an ionomer resin and a thermoplastic styrene elastomer are liable to be back spun compared to golf balls having a cover in which an ionomer resin is used alone. The back spin results in the generation of lift force. Although the lift force is essential in a flight performance of a golf ball, excess lift performance may rather reduce flight distance. Particularly, excess lift force in a high speed area immediately after the impact with a driver results in hopping of the golf ball, and thus the flight distance is drastically reduced. In spite of the excellent resilience performance of the golf ball having a cover composed of the aforementioned mixture, the flight performance is insufficient.

SUMMARY OF THE INVENTION

An object of the present invention is to provide a golf ball which is excellent in resilience performance, feel at impact and flight performance.

A golf ball according to the present invention has a core, a cover and numerous dimples formed on the surface of this cover. Base polymer of this cover includes a mixture of an ionomer resin and a thermoplastic elastomer as a principal component. Shore D hardness of this cover is 55 or greater and 70 or less. Proportion of number of dimples having the tilt angle $\alpha$ of from the position, which is 20% downward from the dimple edge in an in-depth direction, down to the position, which is 50% downward from the dimple edge, of 65° or greater and 85° or less occupied in total number of dimples is equal to or greater than 20%.

Since an ionomer resin and a thermoplastic elastomer are used in combination in the base polymer of this cover, this golf ball is excellent in the resilience performance and feel at impact. Since this golf ball has dimples having the tilt angle $\alpha$ of 65° or greater and 85° or less, it is excellent in the flight performance. Although grounds for the contribution of the dimples having the tilt angle $\alpha$ of 65° or greater and 85° or less to the flight performance are uncertain in detail, it is speculated that the lift force is suppressed in a high speed area immediately after the impact, whilst sufficient lift force is generated in a low speed area following the peak of trajectory. The dimples compensate for the drawbacks of the cover according to this golf ball.

Preferably, the base polymer of the cover includes a mixture of an ethylene-(meth)acrylic acid copolymer based ionomer resin and a thermoplastic elastomer containing a styrene block, as a principal component. Weight ratio of this ionomer resin and thermoplastic elastomer is 70/30 or greater and 98/2 or less. The ethylene-(meth)acrylic acid copolymer based ionomer resin is responsible for the resilience performance of the golf ball, and the thermoplastic elastomer containing a styrene block is responsible for the feel at impact of the golf ball. In light of achievement of both of the resilience performance and the feel at impact, Shore D hardness of the ethylene-(meth) acrylic acid copolymer based ionomer resin is preferably 50 or greater and 70 or less, whilst JIS-A hardness of the thermoplastic elastomer containing a styrene block is preferably 30 or greater and 80 or less.

In light of achievement of both of the resilience performance and the feel at impact, the flexural rigidity of the cover is preferably 100 MPa or greater and 350 MPa or less.

In light of the flight performance, a proportion of number of dimples, which satisfy the following (1) and (2), occupied in total number of the dimples is preferably equal to or greater than 20%:

(1) having a first curved face starting from the position, which is 85% downward from the dimple edge in an in-depth direction, down to the position, which is 100% downward from the dimple edge in an in-depth direction, and a second curved face starting from the position, which is 20% downward from the dimple edge in an in-depth direction, down to the position, which is 50% downward from the dimple edge in an in-depth direction; and (2) having a ratio (R1/R2) of a curvature radius R1 of the first curved face and a curvature radius R2 of the second curved face of 5 or greater and 55 or less.

DESCRIPTION OF THE PREFERRED EMBODIMENTS

The present invention is hereinafter described in detail with appropriate references to the accompanying drawing according to the preferred embodiments of the present invention.

Figure 1:
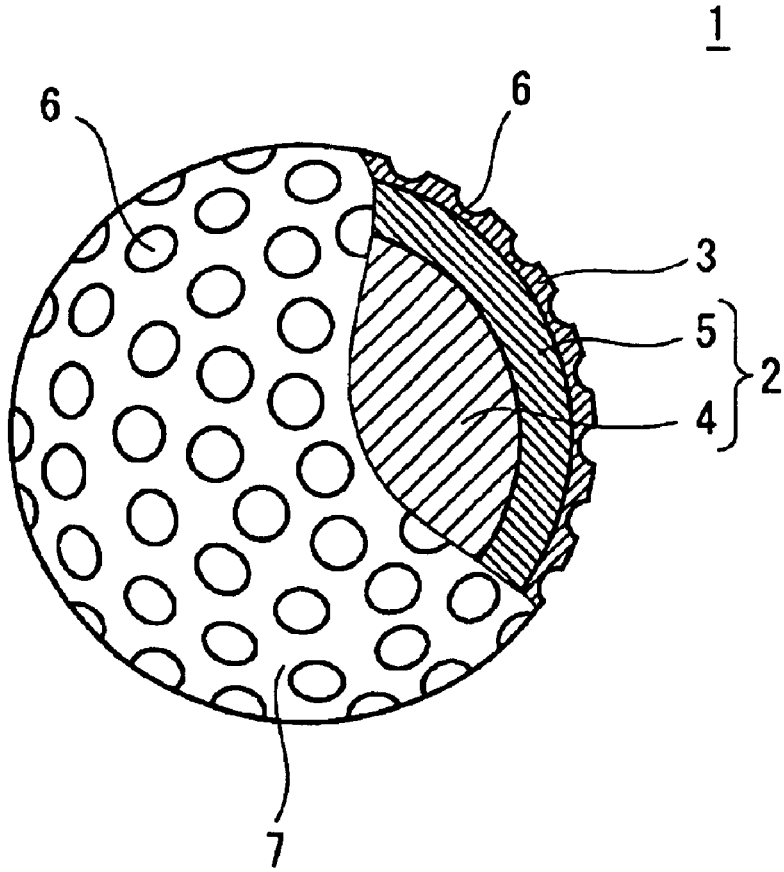
FIG. 1 is a schematic cross-sectional view illustrating a golf ball according to one embodiment of the present invention.

A golf ball 1 depicted in FIG. 1 has a spherical core 2 and a cover 3. The core 2 is composed of a spherical center 4 and a mid layer 5. Numerous dimples 6 are formed on the surface of the cover 3. Of the surface of the golf ball 1, a part except for the dimples 6 is a land 7. Although this golf ball 1 has a paint layer and a mark layer to the external side of the cover 3, these layers are not shown in the Figure.

This golf ball 1 has the diameter of from 40 mm to 45 mm in general, and in particular, of from 42 mm to 44 mm. In light of the reduction of air resistance in the range to comply with a rule defined by United States Golf Association (USGA), the diameter is particularly preferably 42.67 mm or greater and 42.80 mm or less. Weight of this golf ball 1 is generally 40 g or greater and 50 g or less, and in particular, 44 g or greater and 47 g or less. In light of the elevation of inertia in the range to comply with a rule defined by USGA, the weight is particularly preferably 45.00 g or greater and 45.93 g or less.

The cover 3 herein means an outermost layer except for the paint layer and the mark layer. There exist golf balls referred to a shaving a two-layered cover, and in this instance, the outer layer corresponds to the cover 3 herein.

For the cover 3, an ethylene-(meth) acrylic acid copolymer based ionomer resin and a thermoplastic elastomer containing a styrene block are employed as a base polymer through blending of the same. Proportion of total amount of the ethylene-(meth)acrylic acid copolymer based ionomer resin and the thermoplastic elastomer containing a styrene block occupied in the entire base polymer is preferably equal to or greater than 50% by weight, more preferably equal to or greater than 70% by weight, still more preferably equal to or greater than 90% by weight, and most preferably 100% by weight. This cover 3 is responsible for the resilience performance and feel at impact of the golf ball 1.

The ethylene-(meth)acrylic acid copolymer based ionomer resin is obtained by copolymerizing ethylene with acrylic acid or methacrylic acid. This ionomer resin generally contains an ethylene component of 70% by weight or greater and 95% by weight or less, and an acrylic acid component or a methacrylic acid component of 5% by weight or greater and 30% by weight or less. A part of carboxylic acids in the copolymer is neutralized by a metal ion. Illustrative examples of the metal ion for use in neutralization include sodium ion, potassium ion, lithium ion, zinc ion, calcium ion, magnesium ion, aluminum ion and neodymium ion. The neutralization may be conducted with two or more kinds of metal ions. Particularly suitable metal ion in light of the resilience performance and durability of the golf ball is sodium ion, zinc ion, lithium ion and magnesium ion.

Specific examples of the ethylene-(meth)acrylic acid copolymer based ionomer resin include "Himilan 1555", "Himilan 1557", "Himilan 1605", "Himilan 1706", "Himilan 1707", "Himilan AM7311", "Himilan AM7315", "Himilan AM7317", "Himilan AM7318" and "Himilan MK7320", trade names by Mitsui-Dupont Polychemical Co. Ltd.; "Surlyn® 7930", "Surlyn® 7940", "Surlyn® 8940", "Surlyn® 8945", "Surlyn® 9910" and "Surlyn® 9945", trade names by Dupont; and "IOTEK 7010", "IOTEK 7030", "IOTEK 8000" and "IOTEK 8030", trade names by Exxon Corporation.

Shore D hardness of the ethylene-(meth)acrylic acid copolymer based ionomer resin is preferably 50 or greater and 70 or less. When the Shore D hardness is less than the above range, the resilience performance of the golf ball 1 may become insufficient. In this respect, the Shore D hardness is more preferably equal to or greater than 52, and particularly preferably equal to or greater than 55. When the Shore D hardness is beyond the above range, the feel at impact of the golf ball 1 may become insufficient. In this respect, the Shore D hardness is more preferably equal to or less than 68, and particularly preferably equal to or less than 65. Shore D hardness is measured in accordance with a standard of "ASTM-D 2240-68", with a Shore D type spring hardness scale. Upon the measurement, a slab produced by compression molding of the ethylene-(meth)acrylic acid copolymer based ionomer resin is used.

Flexural rigidity of the ethylene-(meth)acrylic acid copolymer based ionomer resin is preferably 200 MPa or greater and 500 MPa or less. When the flexural rigidity is less than the above range, the resilience performance of the golf ball 1 may become insufficient. In this respect, the flexural rigidity is more preferably equal to or greater than 220 MPa, still more preferably equal to or greater than 240 MPa, and particularly preferably equal to or greater than 250 MPa. When the flexural rigidity is beyond the above range, the feel at impact of the golf ball 1 may become insufficient. In this respect, the flexural rigidity is more preferably equal to or less than 480 MPa, and particularly preferably equal to or less than 450 MPa. The flexural rigidity is measured in accordance with a standard of "JIS K7106". Upon the measurement, a slab produced by compression molding of the ethylene-(meth)acrylic acid copolymer based ionomer resin is used. This slab is maintained in a circumstance of 23° C. for two weeks following the molding, and then subjected to the measurement.

Examples of the thermoplastic elastomer containing a styrene block include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Exemplary hydrogenated SBS include styrene-ethylene-butylene-styrene block copolymers (SEBS). Exemplary hydrogenated SIS include styrene-ethylene-propylene-styrene block copolymers (SEPS). Exemplary hydrogenated SIBS include styrene-ethylene-ethylene-propylene-styrene block copolymers (SEEPS). A thermoplastic elastomer with an epoxy group added to a block other than the styrene block may be also used.

Percentage content of the styrene component in the thermoplastic elastomer is preferably 10% by weight or greater and 50% by weight or less. When the percentage content is less than the above range, the resilience performance of the golf ball 1 may become insufficient. In this respect, the percentage content is more preferably equal to or greater than 12% by weight, and particularly preferably equal to or greater than 15% by weight. When the percentage content is beyond the above range, the feel at impact of the golf ball 1 may become insufficient. In this respect, the percentage content is more preferably equal to or less than 47% by weight, and particularly preferably equal to or less than 45% by weight.

Also, any alloy of SBS, SIS, SIBS, SEBS, SEPS or SEEPS with an olefin may be used. The olefin component in this alloy is speculated to contribute to the improvement of compatibility between the thermoplastic elastomer and the ionomer resin. By using this alloy, the resilience performance of the golf ball 1 is improved. Preferably, an olefin having 2 or greater and 10 or less carbon atoms is used.

Specific examples of the thermoplastic elastomer containing a styrene block include "Epofriend®A1010", a trade name by Daicel Chemical Industries; "Septon HG-252", a trade name by Kuraray Co., Ltd.; and "Rabalon® SJ4400N", "Rabalono SJ5400N", "Rabalon®SJ6400N", "Rabalon®SJ7400N", "Rabalon® SJ8400N", "Rabalon®SJ9400N" and "Rabalon® SR04", tradenames by Mitsubishi Chemical Corporation.

JIS-A hardness of the thermoplastic elastomer containing a styrene block is preferably 30 or greater and 80 or less. When the JIS-A hardness is less than the above range, the resilience performance of the golf ball 1 may become insufficient. In this respect, the JIS-A hardness is more preferably equal to or greater than 32, and particularly preferably equal to or greater than 35. When the JIS-A hardness is beyond the above range, the feel at impact of the golf ball 1 may become insufficient. In this respect, the JIS-A hardness is more preferably equal to or less than 75, and particularly preferably equal to or less than 65. JIS-A hardness is measured in accordance with a standard of "JIS K 6301", with an A type spring hardness scale. Upon the measurement, a slab produced by compression molding of the thermoplastic elastomer is used.

Flexural rigidity of the thermoplastic elastomer containing a styrene block is preferably equal to or less than 15 MPa. When the flexural rigidity is beyond the above range, the feel at impact of the golf ball 1 may become insufficient. In this respect, the flexural rigidity is more preferably equal to or less than 12 MPa, and particularly preferably equal to or less than 10 MPa. The flexural rigidity is measured in accordance with a standard of "JIS K7106". Upon the measurement, a slab produced by compression molding of the thermoplastic elastomer is used. This slab is maintained in a circumstance of 23° C. for two weeks following the molding, and then subjected to the measurement.

Weight ratio of the ethylene-(meth)acrylic acid copolymer based ionomer resin and the thermoplastic elastomer containing a styrene block in the cover 3 is preferably 70/30 or greater and 98/2 or less. When the weight ratio is less than the above range, the resilience performance of the golf ball 1 may become insufficient. In this respect, the weight ratio is more preferably equal to or greater than 80/20, and particularly preferably equal to or greater than 85/15. When the weight ratio is beyond the above range, the feel at impact of the golf ball 1 may become insufficient. In this respect, the weight ratio is more preferably equal to or less than 97/3, and particularly preferably equal to or less than 95/5.

Other ionomer resin may be used instead of or together with the ethylene-(meth)acrylic acid copolymer based ionomer resin. Examples of the other ionomer resin include ethylene-(meth)acrylic acid-(meth)acrylate ester ternary copolymer based ionomer resins. Other thermoplastic elastomer may be used instead of or together with the thermoplastic elastomer containing a styrene block. Examples of the other elastomer include thermoplastic polyurethane elastomers, thermoplastic polyamide elastomers, thermoplastic polyester elastomers and thermoplastic polyolefin elastomers. When other ionomer resin or other thermoplastic elastomer is used, weight ratio of total amount of all kinds of the ionomer resins and total amount of all kinds of the thermoplastic elastomers is preferably 70/30 or greater and 98/2 or less.

As the base polymer for the cover 3, other polymer may be used together with the ionomer resin and the thermoplastic elastomer. Examples of the other polymer include polyolefins, polyesters, polyamides, polyurethanes and polystyrenes. When other polymer is used in combination, a proportion of total amount of the ionomer resin and the thermoplastic elastomer occupied in the entire base polymer is preferably equal to or greater than 50% by weight, more preferably equal to or greater than 70% by weight, still more preferably equal to or greater than 90% by weight, and most preferably 100% by weight.

Shore D hardness of the cover 3 is 55 or greater and 70 or less. When the Shore D hardness is less than the above range, the resilience performance of the golf ball 1 may become insufficient. In this respect, the Shore D hardness is more preferably equal to or greater than 56, and particularly preferably equal to or greater than 57. When the Shore D hardness is beyond the above range, the feel at impact of the golf ball 1 may become insufficient. In this respect, the Shore D hardness is more preferably equal to or less than 65, and particularly preferably equal to or less than 63. Upon the measurement of the Shore D hardness, a slab produced by compression molding of a resin composition having the identical constitution to that of the cover 3 is used.

Flexural rigidity of the cover 3 is preferably 100 MPa or greater and 350 MPa or less. When the flexural rigidity is less than the above range, the resilience performance of the golf ball 1 may become insufficient. In this respect, the flexural rigidity is more preferably equal to or greater than 150 MPa, and particularly preferably equal to or greater than 170 MPa. When the flexural rigidity is beyond the above range, the feel at impact of the golf ball 1 may become insufficient. In this respect, the flexural rigidity is more preferably equal to or less than 300 MPa, and particularly preferably equal to or less than 270 MPa. Upon the measurement of the flexural rigidity, a slab produced by compression molding of a resin composition having the identical constitution to that of the cover 3 is used.

To the cover 3 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 3 may be also blended with powder of a highly dense metal such as tungsten, molybdenum or the like for the purpose of adjusting the specific gravity.

Thickness of the cover 3 is 0.5 mm or greater and 2.5 mm or less, and in particular, 0.8 mm or greater and 2.2 mm or less. Specific gravity of the cover is 0.90 or greater and 1.10 or less, and in particular, 0.95 or greater and 1.05 or less.

In general, the center 4 is obtained through crosslinking of a rubber composition. Examples of suitable base rubber for use in the rubber composition include polybutadienes, polyisoprenes, styrene-butadiene copolymers, ethylene-propylene-diene copolymers, natural rubbers and the like. Two or more kinds of these rubbers may be used in combination. In light of the resilience performance, polybutadienes are preferred. In the case where other rubber is used in combination with a polybutadiene, to employ a polybutadiene as a principal component is preferred. Specifically, it is preferred that a proportion of polybutadiene occupied in the entire base rubber be equal to or greater than 50% by weight, and particularly equal to or greater than 80% by weight. High cis polybutadienes which have a percentage of the cis-1, 4 bond of equal to or greater than 40%, and particularly equal to or greater than 80% are particularly preferred.

For crosslinking of the center 4, a co-crosslinking agent is usually used. Preferable co-crosslinking agent in light of the resilience performance is a monovalent or bivalent metal salt of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate is particularly preferred on the ground that a high resilience performance can be achieved.

As a co-crosslinking agent, also an α,β-unsaturated carboxylic acid having 2 to 8 carbon atoms, and a metal oxide may be blended. Both components react in the rubber composition to give a salt. This salt serves as a co-crosslinking agent. Examples of preferable α,β-unsaturated carboxylic acid include acrylic acid and methacrylic acid, and acrylic acid is particularly preferred. Examples of preferable metal oxide include zinc oxide and magnesium oxide, and zinc oxide is particularly preferred.

The amount of the co-crosslinking agent to be blended is preferably 10 parts by weight or greater and 50 parts by weight or less per 100 parts by weight of the base rubber. When the amount to be blended is less than the above range, the resilience performance of the golf ball 1 may become insufficient. In this respect, the amount to be blended is more preferably equal to or greater than 12 parts by weight, and particularly preferably equal to or greater than 15 parts by weight. When the amount to be blended is beyond the above range, the feel at impact of the golf ball 1 may become hard. In this respect, the amount to be blended is particularly preferably equal to or less than 45 parts by weight.

In the rubber composition for use in the center 4, an organic peroxide may be preferably blended together with the co-crosslinking agent. The organic peroxide is responsible for a crosslinking reaction. By blending the organic peroxide, the resilience performance of the golf ball 1 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy) hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount to be blended is less than the above range, the resilience performance of the golf ball 1 may become insufficient. In this respect, the amount to be blended is more preferably equal to or greater than 0.3 part by weight, and particularly preferably equal to or greater than 0.5 part by weight. When the amount to be blended is beyond the above range, the feel at impact of the golf ball 1 may become hard. In this respect, the amount to be blended is particularly preferably equal to or less than 2.5 parts by weight.

The center 4 may be blended with a filler for the purpose of adjusting specific gravity and the like. Illustrative examples of suitable filler include zinc oxide, barium sulfate, calcium carbonate and magnesium carbonate. Powder of highly dense metal may be blended as a filler. Specific examples of the highly dense metal include tungsten and molybdenum. The amount of the filler to be blended is determined ad libitum so that the intended specific gravity of the center 4 can be accomplished. Particularly preferable filler is zinc oxide. Zinc oxide serves not only as a mere agent for adjusting specific gravity but also as a crosslinking activator. Various kinds of additives such as sulfur, an anti-aging agent, a coloring agent, a plasticizer, a dispersant and the like may be blended at an appropriate amount to the center 4 as needed. The center 4 may be also blended with crosslinked rubber powder or synthetic resin powder.

The diameter of the center 4 is 25 mm or greater and 41 mm or less, and particularly 27 mm or greater and 40 mm or less. Crosslinking temperature of the center 4 is usually 140° C. or greater and 180° C. or less. The crosslinking time period of the center 4 is usually 10 minutes or longer and 60 minutes or less. Specific gravity of the center 4 is 0.90 or greater and 1.40 or less, and particularly 0.95 or greater and 1.30 or less. The center may have two or more layers.

The mid layer 5 is usually composed of a crosslinked rubber. The base rubber for the mid layer 5 is similar to the base rubber for the center 4 as described above. Similar co-crosslinking agent and organic peroxide to those which may be blended in the center 4 as described above can be blended in the mid layer 5. The amount of the co-crosslinking agent to be blended is preferably 15 parts by weight or greater and 50 parts by weight or less per 100 parts by weight of the base rubber. When the amount to be blended is less than the above range, the resilience performance of the golf ball 1 may become insufficient. In this respect, the amount to be blended is more preferably equal to or greater than 20 parts by weight. When the amount to be blended is beyond the above range, the feel at impact of the golf ball 1 may become deteriorated. In this respect, the amount to be blended is more preferably equal to or less than 45 parts by weight, and particularly preferably equal to or less than 40 parts by weight.

The amount of the organic peroxide to be blended in the mid layer 5 is preferably 0.1 part by weight or greater and 6.0 parts by weight or less per 100 parts by weight of the base rubber. When the amount to be blended is less than the above range, the resilience performance of the golf ball 1 may become insufficient. In this respect, the amount to be blended is more preferably equal to or greater than 0.3 part by weight, and particularly preferably equal to or greater than 0.5 part by weight. When the amount to be blended is beyond the above range, the feel at impact of the golf ball 1 may become hard. In this respect, the amount to be blended is more preferably equal to or less than 5.0 parts by weight, and particularly preferably equal to or less than 4.0 parts by weight. Also in the mid layer 5, may be blended a similar filler and various kinds of additives to those which may be blended in the center 4 as described above.

The mid layer 5 may be composed of a resin composition. Illustrative examples of suitable base polymer in this instance include ionomer resins, thermoplastic polyester elastomers, thermoplastic polyamide elastomers, thermoplastic polyurethane elastomers, thermoplastic polyolefin elastomers and thermoplastic polystyrene elastomers. Two or more kinds of the synthetic resins may be used in combination.

Thickness of the mid layer 5 is preferably 0.5 mm or greater and 4.0 mm or less, and particularly 1.0 mm or greater and 3.0 mm or less. Specific gravity of the mid layer 5 is 0.90 or greater and 1.40 or less, and particularly 0.95 or greater and 1.30 or less. The mid layer may have two or more layers.

Figure 2:
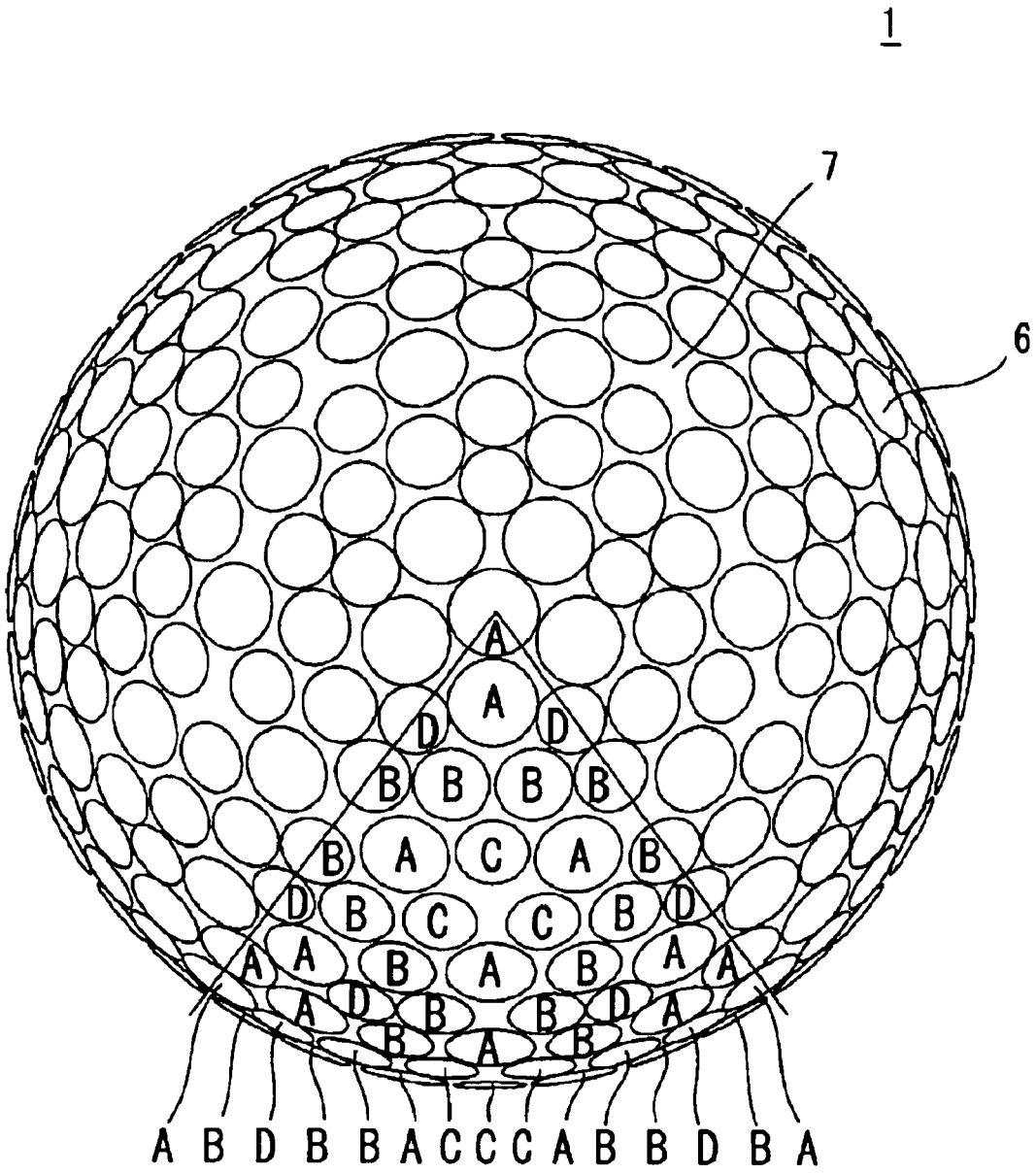
FIG. 2 is an enlarged plan view illustrating the golf ball shown in FIG. 1.
Figure 3:
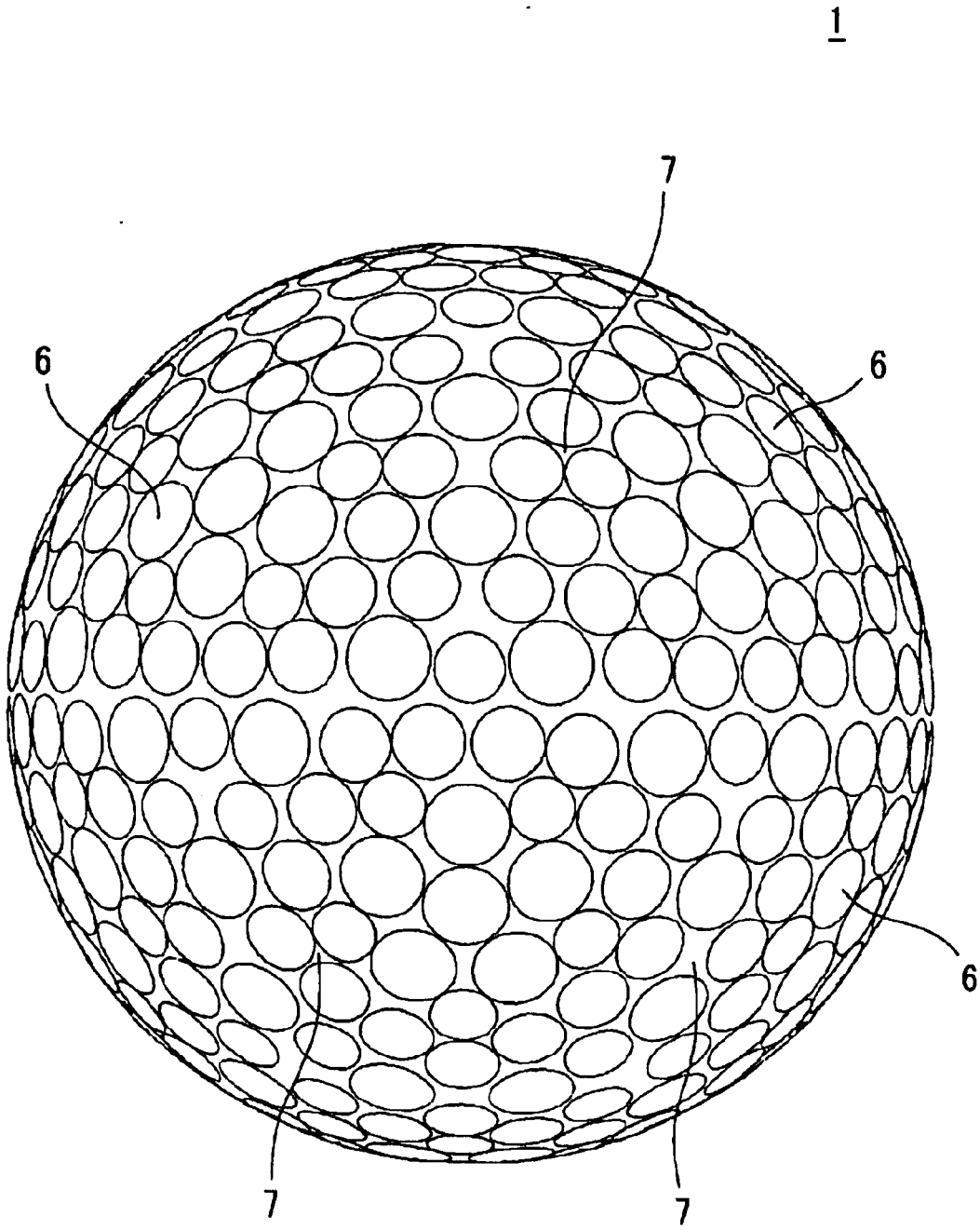
FIG. 3 is an enlarged front view illustrating the golf ball shown in FIG. 1.

FIG. 2 is an enlarged plan view illustrating the golf ball 1 shown in FIG. 1, and FIG. 3 is a front view of the same. As is clear from FIG. 2 and FIG. 3, all dimples 6 have a plane shape of circular. In FIG. 2, kinds of dimples 6 are depicted by symbols A to D in one unit, when the surface of the golf ball 1 is comparted into 10 equivalent units. This golf ball 1 includes A dimples having the diameter of 4.1 mm, B dimples having the diameter of 3.6 mm, C dimples having the diameter of 3.4 mm and D dimples having the diameter of 3.2 mm. Number of the A dimple is 132; number of the B dimple is 180; number of the C dimple is 60; and number of the D dimple is 60. Total number of the dimples 6 of this golf ball 1 is 432.

Figure 4:
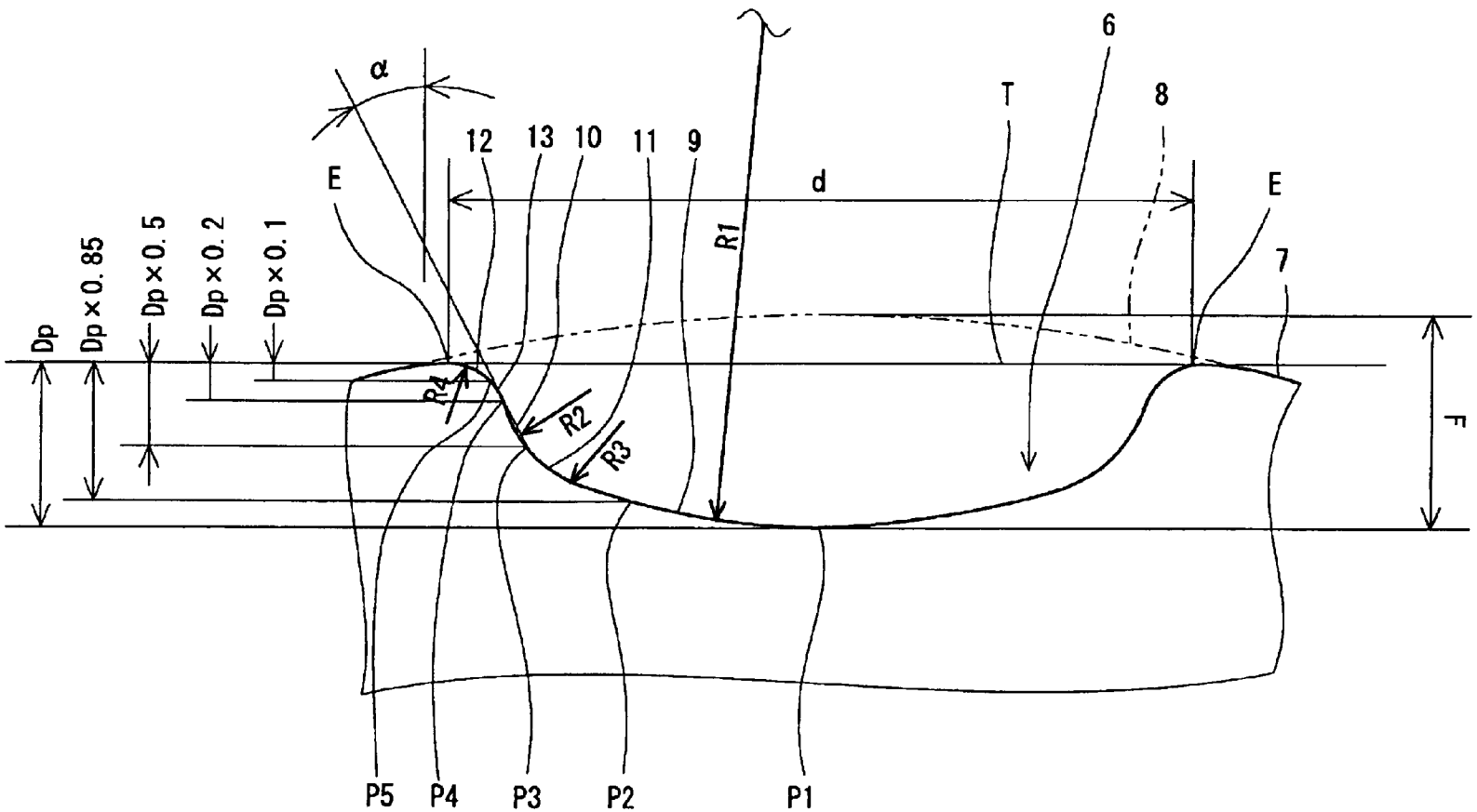
FIG. 4 is an enlarged cross-sectional view illustrating a part of the golf ball shown in FIG. 1.

FIG. 4 is an enlarged longitudinal cross-sectional view illustrating a part of the golf ball 1 shown in FIG. 1. In this Figure, a cross-section traversing the deepest place of the dimple 6 and the center of the golf ball 1 is depicted. Vertical direction in FIG. 4 is the in-depth direction of the dimple 6. The in-depth direction refers to a direction from the weighted center of area of the dimple 6 toward the center of the golf ball 1. What is depicted by a chain double-dashed line in FIG. 4 is a phantom sphere 8. The surface of the phantom sphere 8 is a surface of the golf ball 1 when it was postulated that there is no dimple 6 existed. The dimple 6 is recessed from the phantom sphere 8. The land 7 agrees with the phantom sphere 8.

What is depicted by a both-sided arrow d in FIG. 4 is a diameter of the dimple 6. This diameter d is a distance between one contact point E and another contact point E, provided when a tangent line T which is common to both sides of the dimple 6 is depicted. The contact point E is also an edge of the dimple 6. The edge E defines the plane shape of the dimple 6. In FIG. 4, what is depicted by the symbol P1 is the deepest part of the dimple 6. Distance between the tangent line T and the deepest part P1 is the depth Dp of the dimple 6.

In FIG. 4, what is depicted by the symbol P2 is a point which is downward from the edge E by a distance of (Dp·0.85). What is depicted by the symbol P3 is a point which is downward from the edge E by a distance of (Dp·0.5). What is depicted by the symbol P4 is a point which is downward from the edge E by a distance of (Dp·0.2). What is depicted by the symbol P5 is a point which is downward from the edge E by a distance of (Dp·0.1).

In FIG. 4, what is depicted by both-sided arrowheads $\alpha$ is a tilt angle of from the position (P4), which is 20% downward from the dimple edge in an in-depth direction, down to the position (P3), which is 50% downward from the dimple edge in an in-depth direction. This tilt angle $\alpha$ is an angle of a straight line, which connects between the position P3 and the position P4, toward the in-depth direction. The tilt angle $\alpha$ is 65° (degree) or greater and 85° or less. This tilt angle $\alpha$ of the dimple 6 is smaller than the tilt angle $\alpha$ of general dimples. It is speculated that dimples 6 having the tilt angle $\alpha$ within the aforementioned range suppress the generation of lift force in instances where the golf ball 1 flies at high speed, and accelerate the generation of lift force in instances where the golf ball 1 flies at low speed.

The golf ball 1 immediately after the impact with a driver flies at a high speed. In this case, the lift force generated by the dimples 6 having a small tilt angle $\alpha$ is less than the lift force generated by general dimples. In the golf ball 1 according to the present invention, due to the cover 3 including a mixture of the ionomer resin and the thermoplastic elastomer as a principle component, high back spin speed is attained. Dimples 6 having a small tilt angle $\alpha$ prevent this golf ball 1 from generating excess lift force, in spite of the high back spin speed. This golf ball 1 hardly hops. Thus, loss of the travel distance due to hopping can be reduced, according to this golf ball 1.

The golf ball 1 hit by a driver passes a peak of the trajectory, and then flies at a low speed. In this instance, the lift force generated by dimples 6 having a small tilt angle $\alpha$ is equal to the lift force generated by general dimples. On behalf of sufficient lift force generated following the peak of the trajectory, correlatively to the high back spin speed, duration of a flight of the golf ball 1 is prolonged, thereby increasing the flight distance.

Golf ball 1 hit by a short iron flies at a low speed following immediately after the impact. In this instance, the lift force generated by dimples 6 having a small tilt angle $\alpha$ is equal to the lift force generated by general dimples. Correlatively to the high back spin speed, sufficient lift force is generated toward the golf ball 1. Trajectory of this golf ball 1 hit by a short iron has a large angle of fall, therefore, short run (roll) is attained. This golf ball 1 is excellent in the control performance with a short iron.

In light of the control performance with a short iron, the tilt angle $\alpha$ is preferably equal to or greater than 67°, furthermore equal to or greater than 70°, still more equal to or greater than 77°, and even more equal to or greater than 79°. In light of the travel distance with a driver, the tilt angle $\alpha$ is preferably equal to or less than 84°, furthermore equal to or less than 83°, and even more equal to or less than 82°.

It is preferred that the tilt angle $\alpha$ of 65° or greater and 85° or less is achieved in all of the dimples 6. When a part of the dimples 6 has the tilt angle $\alpha$ within the range described above, whilst the residual dimples have the tilt angle $\alpha$ out of the range described above, proportion of number of dimples having the tilt angle $\alpha$ of within the range described above occupied in total number of dimples 6 is set to be equal to or greater than 20%. This proportion is more preferably equal to or greater than 50%, still more preferably equal to or greater than 70%, even more preferably equal to or greater than 85%, and particularly preferably equal to or greater than 90%.

The dimple 6 has a first curved face 9, a second curved face 10, a third curved face 11, a fourth curved face 12 and a fifth curved face 13. The first curved face 9 has a bowl-like shape, and the second curved face 10, the third curved face 11, the fourth curved face 12 and the fifth curved face 13 have a ring-like shape. The first curved face 9 is positioned lower than the point P2. The first curved face 9 includes the deepest part P1. The second curved face 10 is positioned between the point P3 and the point P4. The third curved face 11 is positioned between the point P2 and the point P3. The fourth curved face 12 is positioned upper than the point P5. The fifth curved face 13 is positioned between the point P4 and the point P5. The first curved face 9 is serially connected to the third curved face 11. The third curved face 11 is serially connected to the first curved face 9 and the second curved face 10. The second curved face 10 is serially connected to the third curved face 11 and the fifth curved face 13. The fifth curved face 13 is serially connected to the second curved face 10 and the fourth curved face 12. The fourth curved face 12 is serially connected to the fifth curved face 13 and the land 7. In other words, the first curved face 9, the third curved face 11, the second curved face 10, the fifth curved face 13 and the fourth curved face 12 are serially connected in this order from the deepest part P1 toward the edge E.

The first curved face 9 is entirely convex inward. Although the first curved face 9 may be partially convex outward, or may be partially flat with respect to both inside and outside directions, it is preferably convex inward over the whole region. The phrase "curved face being flat with respect to both inside and outside directions" herein means that longitudinal cross section of the curved face exhibits a straight line. The second curved face 10 is entirely convex inward. Although the second curved face 10 may be partially convex outward, or may be partially flat with respect to both inside and outside directions, it is preferably convex inward over the whole region. The third curved face 11 is entirely convex inward. Although the third curved face 11 may be partially convex outward, or maybe partially flat with respect to both inside and outside directions, it is preferably convex inward over the whole region. The fourth curved face 12 is entirely convex outward. Although the fourth curved face 12 may be partially convex inward, or may be partially flat with respect to both inside and outside directions, it is preferably convex outward over the whole region.

The fifth curved face 13 may be composed of only a region which is convex inward, may be composed of only a region which is convex outward, may be composed of a region which is flat with respect to both inside and outside directions, or may be composed of multiple regions with different convex directions. As described above, the fifth curved face 13 is serially connected to the second curved face 10 and the fourth curved face 12. Therefore, it is preferred that the lower region of the fifth curved face 13 (the region which serially connects to the second curved face 10) is convex inward, and the upper region (the region which serially connects to the fourth curved face 12) is convex outward. In this instance, the fifth curved face 13 preferably includes an inflection point between the region which is convex inward and the region which is convex outward.

The curvature radius R1 of the first curved face 9 is a radius of a circular arc, which circular arc is envisioned such that it passes three points of: the point P2 shown in FIG. 4; other point P2 opposing to this point P2 with the deepest part P1 intervened therebetween; and the deepest part P1. The region among the point P2 and the other point P2 in this circular arc is convex inward. The curvature radius R2 of the second curved face 10 is a radius of a circular arc, which circular arc is envisioned such that it passes three points of: the point P3; the point which is downward from the edge E by a distance of (Dp·0.35); and the point P4. The region among the point P3 and the point P4 in this circular arc is convex inward. The curvature radius R3 of the third curved face 11 is a radius of a circular arc, which circular arc is envisioned such that it passes three points of: the point P2; the point which is downward from the edge E by a distance of (Dp·0.675); and the point P3. The region among the point P2 and the point P3 in this circular arc is convex inward. The curvature radius R4 of the fourth curved face 12 is a radius of a circular arc, which circular arc is envisioned such that it passes three points of: the point P5; the point which is downward from the edge E by a distance of (Dp·0.05); and the edge E. The region among the point P5 and the edge E in this circular arc is convex outward.

Ratio (R1/R2) in this dimple 6 is equal to or greater than 5. This ration (R1/R2) is greater than the ratio (R1/R2) of conventional double radius dimples. This dimple 6 is responsible for the flight performance of the golf ball 1 upon hitting by a driver. Although grounds for the contribution of the dimple 6 to the flight performance of the golf ball 1 are uncertain in detail, it is speculated that lift force is suppressed in a high speed area immediately after the impact with a driver, due to the great ratio (R1/R2) In light of the flight performance, the ratio (R1/R2) is preferably equal to or greater than 10, furthermore equal to or greater than 13, still more equal to or greater than 15, even more equal to or greater than 20, and yet equal to or greater than 22. When the ratio (R1/R2) is too large, air flow on the first curved face 9 becomes monotonous, therefore, the ratio (R1/R2) is preferably equal to or less than 55, furthermore equal to or less than 52, even more equal to or less than 50, and even more equal to or less than 40.

It is preferred that the ratio (R1/R2) of 5 or greater and 55 or less is achieved in all of the dimples 6. When a part of the dimples 6 has the ratio (R1/R2) within the range described above, whilst the residual dimples have the ratio (R1/R2) out of the range described above, a proportion of number of dimples having the ratio (R1/R2) of within the range described above occupied in total number of dimples 6 is set to be equal to or greater than 20%. This proportion is more preferably equal to or greater than 50%, still more preferably equal to or greater than 70%, even more preferably equal to or greater than 85%, and particularly preferably equal to or greater than 90%.

The curvature radius R1 is preferably 2 mm or greater and 60 mm or less, furthermore 4 mm or greater and 59 mm or less, still more 5 mm or greater and 58 mm or less, even more 10 mm or greater and 57 mm or less, still more 15 mm or greater and 56 mm or less, and yet 20 mm or greater and 55 mm or less. The curvature radius R2 is preferably 0.3 mm or greater and 20 mm or less, furthermore 0.5 mm or greater and 19 mm or less, still more 0.5 mm or greater and 18 mm or less, even more 0.5 mm or greater and 10 mm or less, and yet 0.8 mm or greater and 5 mm or less.

Because this golf ball 1 has a great tilt angle α of dimples, vicinity of the edge E is liable to be damaged. According to this golf ball 1, vicinity of the edge E is formed to be the fourth curved face 12, i.e., a curved face which is convex outward. This fourth curved face 12 is responsible for preventing the vicinity of the edge E upon impact from being damaged. In light of preventing the damage, the curvature radius R4 of the fourth curved face 12 is preferably equal to or greater than 0.1 mm, more preferably equal to or greater than 0.2 mm, and particularly preferably equal to or greater than 0.3 mm. When the curvature radius R4 is too large, effects of the dimples on behalf of the second curved face 10 become insufficient, therefore, the curvature radius R4 is preferably equal to or less than 5.0 mm, more preferably equal to or less than 4.0 mm, and particularly preferably equal to or less than 3.0 mm.

What is depicted by a both-sided arrow F in FIG. 4 is a distance between the phantom sphere 8 and the deepest part P1. The distance F is preferably 0.10 mm or greater and 0.60 mm or less. When the distance F is less than the above range, hopping trajectory may be provided. In this respect, the distance F is preferably equal to or greater and 0.125 mm, more preferably equal to or greater than 0.15 mm, and particularly preferably equal to or greater than 0.20 mm. When the distance F is beyond the above range, dropping trajectory may be provided. In this respect, the distance F is preferably equal to or less and 0.55 mm, and particularly preferably equal to or less than 0.50 mm.

As described above, the third curved face 11 is serially connected to the first curved face 9 and the second curved face 10. Preferably, the first curved face 9 and the third curved face 11 tangent to each other. Preferably, the second curved face 10 and the third curved face 11 tangent to each other. The curvature radius R3 of the third curved face 11 is preferably 0.3 mm or greater and 60 mm or less, more preferably 0.3 mm or greater and 40 mm or less, and particularly preferably 0.5 mm or greater and 30 mm or less. The curvature radius R3 is preferably equal to or less than the curvature radius R1 of the first curved face 9, and is particularly preferably less than the curvature radius R1. The curvature radius R3 is preferably equal to or greater than the curvature radius R2 of the second curved face 10, and is particularly preferably greater than the curvature radius R2.

In FIG. 4, volume of a space surrounded by the phantom sphere 8 and the dimple 6 is the volume of the dimple 6. Total volume of the dimples 6 is preferably 300 $mm^3$ or greater and 750 $mm^3$ or less. When the total volume is less than the above range, hopping trajectory may be provided. In this respect, the total volume is more preferably equal to or greater than 350 $mm^3$, and particularly preferably equal to or greater than 400 $mm^3$. When the total volume is beyond the above range, dropping trajectory may be provided. In this respect, the total volume is more preferably equal to or less than 700 $mm^3$, and particularly preferably equal to or less than 600 $mm^3$.

In the golf ball 1 shown in FIG. 1 to FIG. 4, the volume of the A dimple is 1.587 $mm^3$; the volume of the B dimple is 1.087 $mm^3$; the volume of the C dimple is 0.938 $mm^3$; and the volume of the D dimple is 0.771 $mm^3$. Accordingly, total volume of this golf ball 1 is 507.7 $mm^3$.

Proportion of total area of dimples 6 occupied in the surface area of the phantom sphere 8 is referred to as a surface area occupation ratio. The surface area occupation ratio is preferably 70% or greater and 90% or less. When the surface area occupation ratio is less than the above range, lift force of the golf ball 1 in the low speed area may be deficient. In this respect, the surface area occupation ratio is more preferably equal to or greater than 72%, and particularly preferably equal to or greater than 75%. When the surface area occupation ratio is beyond the above range, a dimple 6 may interfere any other dimple 6. In this respect, the surface area occupation ratio is more preferably equal to or less than 88%, and particularly preferably equal to or less than 86%.

The area of the dimple 6 is an area of a region surrounded by the edge line when the center of the golf ball 1 is viewed at infinity (i.e., an area of the plane shape). In the instance of a dimple 6 having a circular plane shape, the area s is calculated by the following formula.

$$s=(d/2)^2\cdot\pi$$

In the golf ball 1 shown in FIG. 1 to FIG. 4, the area of the A dimple is 13.20 $mm^2$; the area of the B dimple is 10.18 $mm^2$; the area of the C dimple is 9.08 $mm^2$; and the area of the D dimple is 8.04 $mm^2$. Total area of these dimples 6 is 4602.0 $mm^2$. The surface area occupation ratio is calculated by dividing this total area by the surface area of the phantom sphere 8. This golf ball 1 has the surface area occupation ratio of 80.3%.

Total number of dimples 6 is preferably 200 or greater and 500 or less. When the total number is less than the above range, effect of the dimples is hardly achieved. In this respect, the total number is more preferably equal to or greater than 230, and particularly preferably equal to or greater than 260. When the total number is beyond the above range, effect of the dimples is hardly achieved due to small size of the individual dimples. In this respect, the total number is more preferably equal to or less than 470, and particularly preferably equal to or less than 440.

The formed dimples 6 may be of one kind, or may be of multiple kinds. In stead of the circular dimples 6, or together with the circular dimples 6, non-circular dimples may be also formed. Specific examples of the non-circular dimple include polygonal dimples, elliptical dimples, oval dimples and egg-shaped dimples. In instances of the non-circular dimple, 4 cross sections are selected through dividing at every 45°, and in these cross sections, curvature radii R1, R2, R3 and R4, and the tilt angle α are measured. Thus obtained data are averaged.

EXAMPLES

Specifications of a core, a cover and dimples were defined as presented in Table 1 below, and golf balls of Examples 1 to 5 and Comparative Examples 1 to 5 were obtained. The diameter of these golf balls is 42.7 mm. Details of the rubber composition of the core are presented in Table 2; details of the resin composition of the cover are presented in Table 3; and details of dimples are presented in Table 4.

TABLE 1

Specification and evaluation results of golf ball

| | | Example 1 | Example 2 | Example 3 | Com. Example 1 | Example 4 | Com. Example 2 | Com. Example 3 | Com. Example 4 | Example 5 | Com. Example 5 |
|---|---|---|---|---|---|---|---|---|---|---|---|
| Center | rubber composition | (i) | (i) | (i) | (i) | (i) | (i) | (i) | (i) | (ii) | (ii) |
| | diameter (mm) | 39.5 | 39.5 | 39.5 | 39.5 | 39.5 | 39.5 | 39.5 | 39.5 | 35.5 | 35.5 |
| Mid layer | rubber composition | — | — | — | — | — | — | — | — | (iii) | (iii) |
| | Shore D hardness | — | — | — | — | — | — | — | — | 62 | 62 |
| | diameter (mm) | — | — | — | — | — | — | — | — | 2.0 | 2.0 |
| Cover | resin composition | P | P | P | P | Q | Q | R | S | P | T |
| | Shore D hardness | 58 | 58 | 58 | 58 | 55 | 55 | 55 | 49 | 58 | 65 |
| | flexural rigidity (MPa) | 190 | 190 | 190 | 190 | 160 | 160 | 140 | 60 | 190 | 290 |
| | thickness (mm) | 1.6 | 1.6 | 1.6 | 1.6 | 1.6 | 1.6 | 1.6 | 1.6 | 1.6 | 1.6 |
| Dimple | Type | I | II | III | IV | I | IV | I | I | I | I |
| | X (%) | 100 | 100 | 100 | 0 | 100 | 0 | 100 | 100 | 100 | 100 |
| Resilience coefficient | | 1.03 | 1.03 | 1.03 | 1.03 | 1.02 | 1.02 | 1.01 | 1.00 | 1.04 | 1.05 |
| Travel distance (m) | | 213 | 212 | 211 | 209 | 212 | 208 | 208 | 206 | 214 | 215 |
| Feel at impact | | A | A | A | A | A | A | B | A | A | D |

Crosslinking condition of center: 160° C. *25 min
Crosslinking condition of mid layer: 155° C. *20 min

TABLE 2

Specification of rubber composition

| | (parts by weight) | | |
|---|---|---|---|
| Type | (i) | (ii) | (iii) |
| Polybutadiene *1 | 100 | 100 | 100 |
| Zinc acrylate | 26 | 23 | 32 |
| Zinc oxide | 10 | 10 | 10 |
| Barium sulfate *2 | appropriate amount | appropriate amount | 10 |
| Dicumyl peroxide | 0.8 | 0.8 | 1.0 |

*1 Trade name "BR-11", JSR Corporation

*2 adjusted to give the weight of the ball of 45.4 g

TABLE 3

Specification of resin composition (parts by weight)

| Type | P | Q | R | S | T |
|---|---|---|---|---|---|
| Himilan 1605 *3 | 50 | 45 | 40 | 40 | 60 |
| Himilan 1706 *4 | 40 | 40 | 30 | 10 | 40 |
| Surlyn 6320 *5 | — | — | 30 | 30 | — |
| Rabalon SR04 *6 | 10 | 15 | — | 20 | — |
| Titanium dioxide | 3 | 3 | 3 | 3 | 3 |

*3 Ethylene-methacrylic acid copolymer based ionomer resin (Mitsui-Dupont Polychemical Co. Ltd.) Shore D hardness: 61

*4 Ethylene-methacrylic acid copolymer based ionomer resin (Mitsui-Dupont Polychemical Co. Ltd.) Shore D hardness: 60

*5 Ethylene-methacrylic acid-acrylate ester ternary copolymer based ionomer resin (DuPont) Shore D hardness: 43

*6 Thermoplastic elastomer containing styrene block (Mitsubishi Chemical Corporation) JIS-A hardness: 45

TABLE 4

Specification of dimples

| | Kinds of dimple | Number | R1 (mm) | R2 (mm) | R4 (mm) | d (mm) | F (mm) | α (°) | R1/R2 | Volume (mm3) | Total volume (mm3) | X (%) | Plan view Front view |
|---|---|---|---|---|---|---|---|---|---|---|---|---|---|
| Type I | A dimple | 132 | 30.00 | 1.00 | 0.50 | 4.10 | 0.209 | 79 | 30.00 | 1.587 | 507.7 | 100.0 | FIG. 2 |
| | B dimple | 180 | 30.00 | 1.00 | 0.50 | 3.60 | 0.175 | 79 | 30.00 | 1.087 | | | FIG. 3 |
| | C dimple | 60 | 30.00 | 1.00 | 0.50 | 3.40 | 0.164 | 79 | 30.00 | 0.938 | | | |
| | D dimple | 60 | 32.50 | 1.50 | 0.50 | 3.20 | 0.145 | 79 | 21.67 | 0.771 | | | |
| Type II | A dimple | 132 | 50.00 | 1.00 | 0.50 | 4.10 | 0.194 | 77 | 50.00 | 1.583 | 507.7 | 100.0 | FIG. 2 |
| | B dimple | 180 | 50.00 | 1.00 | 0.50 | 3.60 | 0.160 | 77 | 50.00 | 1.089 | | | FIG. 3 |
| | C dimple | 60 | 50.00 | 1.00 | 0.50 | 3.40 | 0.149 | 77 | 50.00 | 0.939 | | | |
| | D dimple | 60 | 40.00 | 1.00 | 0.50 | 3.20 | 0.144 | 77 | 40.00 | 0.772 | | | |
| Type III | A dimple | 132 | 7.00 | 1.00 | 0.50 | 4.10 | 0.315 | 82 | 7.00 | 1.585 | 507.8 | 100.0 | FIG. 2 |
| | B dimple | 180 | 7.00 | 1.00 | 0.50 | 3.60 | 0.267 | 82 | 7.00 | 1.088 | | | FIG. 3 |
| | C dimple | 60 | 7.00 | 1.00 | 0.50 | 3.40 | 0.251 | 82 | 7.00 | 0.938 | | | |
| | D dimple | 60 | 7.00 | 1.00 | 0.50 | 3.20 | 0.230 | 82 | 7.00 | 0.773 | | | |

TABLE 4-continued

| | Kinds of dimple | Number | R1 (mm) | R2 (mm) | R4 (mm) | d (mm) | F (mm) | α (°) | R1/R2 | Volume (mm3) | Total volume (mm3) | X (%) | Plan view Front view |
|---|---|---|---|---|---|---|---|---|---|---|---|---|---|
| | | | Specification of dimples | | | | | | | | | | |
| Type IV | A dimple | 132 | 12.80 | 0.50 | 4.10 | 0.269 | 86 | 1.00 | 1.587 | 507.9 | 0.0 | | FIG. 2 |
| | B dimple | 180 | 11.20 | 0.50 | 3.60 | 0.234 | 86 | 1.00 | 1.087 | | | | FIG. 3 |
| | C dimple | 60 | 9.60 | 0.50 | 3.40 | 0.234 | 86 | 1.00 | 0.943 | | | | |
| | D dimple | 60 | 8.80 | 0.50 | 3.20 | 0.222 | 86 | 1.00 | 0.772 | | | | |

X: Proportion of dimples having the tilt angle α of 65° or greater and 85° or less occupied in total number of dimples

[Measurement of Resilience Coefficient]

To the golf ball was impacted a hollow cylinder made of aluminum of which weight being 200 g at a velocity of 40 m/s. Then, velocity of the hollow cylinder prior to and after the impact, and the velocity of the golf ball after the impact were measured. Thus, a resilience coefficient of the golf ball was determined by calculation. Mean values of data which resulted from 12 times measurement are shown in Table 1 above as indices.

[Travel Distance Test]

A driver with a metal head (Sumitomo Rubber Industries, Ltd., "XXIO W#1", loft: 11°, hardness of shaft: R) was equipped with a swing machine (manufactured by True Temper Co.). Then the golf ball was hit under a condition to give the head speed of 40 m/sec, and the travel distance (i.e., the distance from the launching point to the point where the ball stopped) was measured. Mean values of 12 times measurement are shown in Table 1 above.

[Evaluation of Feel at Impact]

Using a driver, the golf balls were hit by 10 skilled golf players. Thus, the feel at impact was evaluated. Those which were evaluated as satisfactory in the feel at impact by 8 or more golf players were assigned "A", those which were evaluated as satisfactory by from 5 to 7 golf players were assigned "B", those which were evaluated as satisfactory by from 2 to 4 golf players were assigned "C", and those which were evaluated as satisfactory by 1 or less golf player were assigned "D". The results are presented in Table 1 above.

As is clear from Table 1, the golf balls of Comparative Examples 1, 2 and 4 are inferior in the travel distance; the golf ball of Comparative Example 3 is inferior in the travel distance and feel at impact; and the golf ball of Comparative Example 5 is inferior in the feel at impact. To the contrary, the golf ball of each of Examples is excellent in the resilience performance, travel distance and feel at impact. Accordingly, advantages of the present invention are clearly indicated by these results of evaluation.

The description herein above is merely for illustrative examples, therefore, various modifications can be made without departing from the principles of the present invention.

What is claimed is:

1. A golf ball which comprises a core, a cover and numerous dimples formed on the surface of said cover, wherein a base polymer of said cover comprises a mixture of an ionomer resin and a thermoplastic elastomer as a principal component, Shore D hardness of said cover is 55 or greater and 70 or less, and a proportion of number of dimples having the tilt angle α of from the position, which is 20% downward from the dimple edge in an in-depth direction, down to the position, which is 50% downward from the dimple edge in an in-depth direction, of 65° or greater and 85° or less occupied in total number of dimples is equal to or greater than 20%.

2. The golf ball according to claim 1 wherein the base polymer of said cover comprises a mixture of an ethylene-(meth)acrylic acid copolymer based ionomer resin and a thermoplastic elastomer containing a styrene block, as a principal component, and weight ratio of both materials is 70/30 or greater and 98/2 or less.

3. The golf ball according to claim 2 wherein Shore D hardness of said ethylene-(meth) acrylic acid copolymer based ionomer resin is 50 or greater and 70 or less, and JIS-A hardness of said thermoplastic elastomer containing a styrene block is 30 or greater and 80 or less.

4. The golf ball according to claim 1 wherein the flexural rigidity of said cover is 100 MPa or greater and 350 MPa or less.

5. The golf ball according to claim 1 wherein a proportion of number of dimples: having a first curved face starting from the position, which is 85% downward from the dimple edge in an in-depth direction, down to the position, which is 100% downward from the dimple edge, and a second curved face starting from the position, which is 20% downward from the dimple edge in an in-depth direction, down to the position, which is 50% downward from the dimple edge in an in-depth direction; and having a ratio (R1/R2) of a curvature radius R1 of the first curved face and a curvature radius R2 of the second curved face of 5 or greater and 55 or less occupied in total number of the dimples is equal to or greater than 20%.

6. The golf ball according to claim 1 wherein said cover has a Shore D hardness of 57 or greater and 63 or less.

7. The golf ball according to claim 1 wherein the tilt angle α is 70° or greater and 82° or less.

8. The golf ball according to claim 1 wherein the tilt angle α is 79° or greater and 82° or less.

9. The golf ball according to claim 1 wherein the proportion of number of dimples having the tilt angle α is equal to or greater than 50%.

10. The golf ball according to claim 1 wherein the proportion of number of dimples having the tilt angle α is equal to or greater than 70%.

11. The golf ball according to claim 1 wherein the proportion of number of dimples having the tilt angle $\alpha$ is equal to or greater than 90%.

12. The golf ball according to claim 5 wherein the ratio (R1/R2) is 10 or greater and 50 or less.

13. The golf ball according to claim 5 wherein the ratio (R1/R2) is 15 or greater and 50 or less.

14. The golf ball according to claim 5 wherein the ratio (R1/R2) is 20 or greater and 40 or less.

15. The golf ball according to claim 5 wherein the proportion of number of dimples having the ratio (R1/R2) is equal to or greater than 50%.

16. The golf ball according to claim 5 wherein the proportion of number of dimples having the ratio (R1/R2) is equal to or greater than 70%.

17. The golf ball according to claim 5 wherein the proportion of number of dimples having the ratio (R1/R2) is equal to or greater than 90%.

* * * * *